US006425225B1

(12) United States Patent
Fantz et al.

(10) Patent No.: US 6,425,225 B1
(45) **Date of Patent: *Jul. 30, 2002**

(54) METHOD OF WRAPPING A BOUQUET

(75) Inventors: Paul Fantz, Imperial, MO (US); Donald E. Weder, Highland, IL (US); Franklin J. Craig, Valley Park, MO (US)

(73) Assignee: Southpac Trust International, Inc.

( * ) Notice: Subject to any disclaimer, the term of this patent is extended or adjusted under 35 U.S.C. 154(b) by 0 days.

This patent is subject to a terminal disclaimer.

(21) Appl. No.: 09/975,679

(22) Filed: Oct. 11, 2001

Related U.S. Application Data

(63) Continuation of application No. 09/747,197, filed on Dec. 22, 2000, now Pat. No. 6,343,457, which is a continuation of application No. 09/249,570, filed on Feb. 12, 1999, now abandoned, which is a continuation of application No. 09/018,386, filed on Feb. 4, 1998, now Pat. No. 5,921,063, which is a continuation of application No. 08/694,130, filed on Aug. 8, 1996, now Pat. No. 5,718,099, which is a continuation of application No. 08/291,378, filed on Aug. 16, 1994, now Pat. No. 5,564,257, which is a continuation of application No. 07/990,226, filed on Dec. 14, 1992, now abandoned.

(51) Int. Cl.[7] ..... B65B 11/02; B65B 13/00

(52) U.S. Cl. ..... 53/399; 53/397; 53/465

(58) Field of Search ..... 53/397, 399, 461, 53/465, 580, 582, 590, 594, 210, 218, 219; 100/10, 16; 493/296

(56) References Cited

U.S. PATENT DOCUMENTS

| | | | |
|---|---|---|---|
| 1,525,015 A | 2/1925 | Weeks | |
| 1,628,111 A | 5/1927 | Bunker | |
| 1,942,017 A | 1/1934 | Baldwin | |
| 1,961,640 A | 6/1934 | Miller | |
| 2,048,042 A | 7/1936 | Wedge | |
| 2,079,116 A | 5/1937 | Gardner | |
| 2,331,543 A | 10/1943 | Emery | |
| 2,685,771 A | 8/1954 | Magnuson et al. | |
| 2,891,365 A | 6/1959 | Heckel | |
| 2,907,157 A | 10/1959 | Romine | |
| 3,508,372 A | 4/1970 | Wallerstein et al. | |
| 3,619,979 A | 11/1971 | Martensson et al. | |
| 3,777,452 A | 12/1973 | Koenders | |
| 3,793,799 A | 2/1974 | Howe et al. | |
| 3,886,026 A | 5/1975 | Kienel | |
| 4,003,189 A | 1/1977 | Little et al. | |
| 4,554,777 A | 11/1985 | Denk et al. | |
| 4,570,415 A | 2/1986 | Centeno | |
| 4,989,396 A | 2/1991 | Weder et al. | |
| 5,020,301 A | 6/1991 | Helms | |
| 5,181,364 A | 1/1993 | Weder | |
| 5,275,674 A | 1/1994 | Sayyadi | |
| 5,564,257 A | 10/1996 | Fantz et al. | |
| 5,718,099 A | 2/1998 | Fantz et al. | |
| 5,921,063 A | 7/1999 | Fantz et al. | |
| 6,343,457 B2 * | 2/2002 | Fantz et al. | 53/399 |

FOREIGN PATENT DOCUMENTS

| | | |
|---|---|---|
| DE | 1166692 | 3/1964 |
| FR | 2580456 | 10/1986 |
| GB | 2214481 | 9/1989 |
| JP | 3162215 | 7/1991 |

* cited by examiner

*Primary Examiner*—Stephen F. Gerrity
(74) *Attorney, Agent, or Firm*—Dunlap, Codding & Rogers, P.C.

(57) ABSTRACT

A method and apparatus for automatically wrapping a sheet about a bouquet of flowers. The sheet having spaced apart defined first and second portions is placed against a support member, such as a prepared table top, and the bouquet is positioned on the sheet with the first and second portions of the sheet extending on right and left sides, respectively, of the bouquet. The first sheet portion is then moved in a path to at least partially encompass the bouquet, and the second sheet portion is moved in a path to at least partially encompass the bouquet and to extend over part of the first sheet portion. The two sheet portions may be secured together by a bonding material, or the first and second portions of the sheet of wrapping material can themselves act as a bonding material by application of appropriate heat sealing, sonic welding, vibratory welding, and similar methods. A stiff wrap ring form may be positioned suspended over the sheet, and the bouquet inserted in the wrap ring form. The stem portion of the bouquet may be tightly wrapped by a separate wrapping operation.

4 Claims, 6 Drawing Sheets

METHOD OF WRAPPING A BOUQUET

CROSS-REFERENCE TO RELATED APPLICATIONS

The present application is a continuation of U.S. Ser. No. 09/747,197, filed Dec. 22, 2000, now U.S. Pat. No. 6,343,457, which is a continuation of U.S. Ser. No. 09/249,570, filed Feb. 12, 1999, now abandoned, which is a continuation of U.S. Ser. No. 09/018,386, filed Feb. 4, 1998, now U.S. Pat. No. 5,921,063, issued Jul. 13, 1999, which is a continuation of U.S. Ser. No. 08/694,130, filed Aug. 8, 1996, now U.S. Pat. No. 5,718,099, issued Feb. 17, 1998, which is a continuation of 08/291,378, filed Aug. 16, 1994 now U.S. Pat. No. 5,564,257, issued Oct. 15, 1996, which is a continuation of 07/990,226, filed Dec. 14, 1992, now abandoned.

BACKGROUND OF THE INVENTION

1. Field of the Invention

The present invention relates generally to wrapping floral groupings, and more particularly, but not by way of limitation, to a method and apparatus for wrapping a bouquet of botanical items automatically.

2. Brief Description of the Prior Art

Wrapping floral groupings, such as bouquets, is an old art. The wrapping protects the floral grouping, maintains the floral grouping in a relatively high moisture environment, makes the floral grouping more attractive, and protects the person giving or receiving the floral grouping by shielding the person or the person's clothing from excess moisture, color or pollen transfer, and damage from thorns and the like. However, in the past, the wrapping of floral groupings to form, for example, a bouquet has been done manually. A florist would select or cut a sheet of wrapping material, place the floral grouping with the stems toward one corner, bring the two corners adjacent the stem corner together in an overlapping fashion, and then secure, or not, as desired, the overlapping portions of the sheet of material together.

There are many disadvantages to manually preparing wrapped floral groupings. The manual process is very time consuming, thereby adding expense to the final product. The resulting wrapped floral grouping may vary considerably in aesthetic value, depending upon the skill and experience of the person doing the wrapping. Even experienced wrappers may not wrap the floral grouping with the proper shape and size, so that the floral grouping may not be secure within the wrapping. Additionally, while the main part of the floral grouping may be adequately wrapped and protected, the stem area of the wrapping does not wrap the stems tight enough and may allow the stems to protrude through the stem end of the wrapping which makes the floral presentation unsightly and, again, can injure a person or damage a person's clothing. Even after a successful or adequate manual wrap, problems arise in attempting to band the wrap or otherwise affix the wrap upon itself. Handling the unbanded or unfastened wrap is awkward and may require two people, one to hold the wrap in place and the other to band or fasten the overlapping corners of the wrap.

There is, therefore, a clear need in the art for a method and apparatus for automatically wrapping floral groupings which provide consistent wrapping of proper shape and size and which can, optionally, prepare a tight wrap of the stem portion of the floral grouping, and/or band or fasten the wrapping, resulting in an aesthetically pleasing floral presentation absent all of the disadvantages resulting from the aforementioned manual wrapping method. The present invention fulfills that need.

SUMMARY OF THE INVENTION

The material which comprises the sheet of material S is preferably selected from the group of materials consisting of: man-made organic polymeric films; fibers or fabric (woven or non-woven, synthetic or natural); metallic and non-metallic foils; paper (coated or uncoated, treated or untreated); cellulose (including cellophane); leather; burlap; "dead fold" or semi-rigid sheet materials including, but not limited to, "dead-fold" plastic sheets, wire laminated flexible sheet material, waxed sheet material, starched or sugared sheet material; and laminates; or combinations thereof. The sheet of material S used with the bouquet wrapping apparatus may employ materials having adhesives or cohesives on both sides of the sheet S, an adhesive on one side and a cohesive on the other side or a cohesive or adhesive on only one side of the sheet S with no adhesive or cohesive on the other side of the sheet S. The sheet S may be a heat sealable material which can be sealed with heat devices. The sheet S may be a weldable film which can be welded with heat or welded sonically or with a vibratory welding means.

"Floral grouping", as used herein, means cut fresh flowers, artificial flowers, a single flower, other fresh and/or artificial plants or other floral materials, and may include other secondary plants and/or ornamentation which add to the aesthetics of the overall floral grouping. The floral grouping has a stem and a bloom end.

The term "botanical item", as used herein, means a natural or artificial herbaceous or woody plant, taken singly or in combination. The term "botanical item" also means any portion or portions of natural or artificial herbaceous or woody plants including stems, leaves, flowers, blossoms, buds, blooms, cones, or roots, taken singly or in combination, or in groupings of such portions such as bouquets or floral groupings.

For convenience, the term "bouquet" will be used hereinafter to substitute for the term "floral grouping". Therefore, when the term "bouquet" is used, what is meant is "floral grouping" as defined above.

The term "bonding material" as used herein includes adhesives, preferably pressure sensitive adhesives, or cohesives. Where the bonding material is a cohesive, a compatible cohesive material must be placed on the adjacent surface for bondingly contacting and bondingly engaging with the first-mentioned cohesive material. The term "bonding material" also includes materials which are heat sealable and, in this instance, the adjacent portions of the material must be brought into contact and then heat must be applied, or generated, to effect the seal. The term "bonding material" as used herein also means a heat sealing lacquer which may be applied to the sheet of material and, in this instance, heat also must be applied, or generated, to effect the sealing. The term "bonding material" as used herein means any type of material or thing which can be used to effect the bonding or connecting of the two adjacent portions of the material or sheet of material to effect the connection or bonding described herein. The term "bonding material" also includes labels, bands, ribbons, strings, tape, staples or combinations thereof.

DISCUSSION

The present invention overcomes the aforementioned disadvantages of manually wrapping bouquets, as is done in the prior art, by providing a method and apparatus for automatically wrapping a sheet of material about a bouquet. A sheet of material having spaced apart defined first and second portions is placed against a support member, such as a prepared table top, and the bouquet is positioned on the sheet with the first and second portions of the sheet extending on right and left sides, respectively, of the bouquet. The first sheet portion is then moved in a path to at least partially encompass the bouquet, and the second sheet portion is moved in a path to at least partially encompass the bouquet and to extend over part of the first sheet portion. Such automatic operation insures proper size and shape for the wrapping material and also assures consistency from one bouquet to another.

In another aspect of the invention, the two sheet portions are secured together by a bonding material, or the first and second portions of the sheet of wrapping material can themselves act as a bonding material by application of appropriate heat sealing, sonic welding, vibratory welding, and similar methods. Alternatively, or additionally, the wrapped bouquet may be elastically or nonelastically banded.

In another aspect of the invention, the stem portion of the bouquet is tightly wrapped by a separate wrapping operation.

In yet a further aspect of the invention, a member defining a wrap ring form may be positioned suspended over the sheet of material, and the bouquet inserted in the wrap ring form. The wrapping process is then performed, and the wrap ring form provides a stiff bouquet encompassing structure about which the sheet of material can be wrapped for improved consistency of shape and size of the finished wrapped product. This is due to the ability of the stiff wrap ring form to accommodate the necessary tension forces applied to the sheet by the wrapping machine, especially at the end of the wrap cycle. Such forces might otherwise crush the bouquet.

BRIEF DESCRIPTION OF THE DRAWINGS

FIG. 6 is a plan view, in partial cross section, of a bouquet stem wrapping unit;

FIG. 8 is an end elevation view of the bouquet stem wrapping unit taken along the line 8—8 in FIG. 1;

FIG. 9A is a side elevation view of a slide assembly shown in phantom in FIG. 1; and FIG. 9B is a bottom plan view of the slide assembly shown in FIG. 9A.

DETAILED DESCRIPTION OF THE PREFERRED EMBODIMENTS

Figure 1:
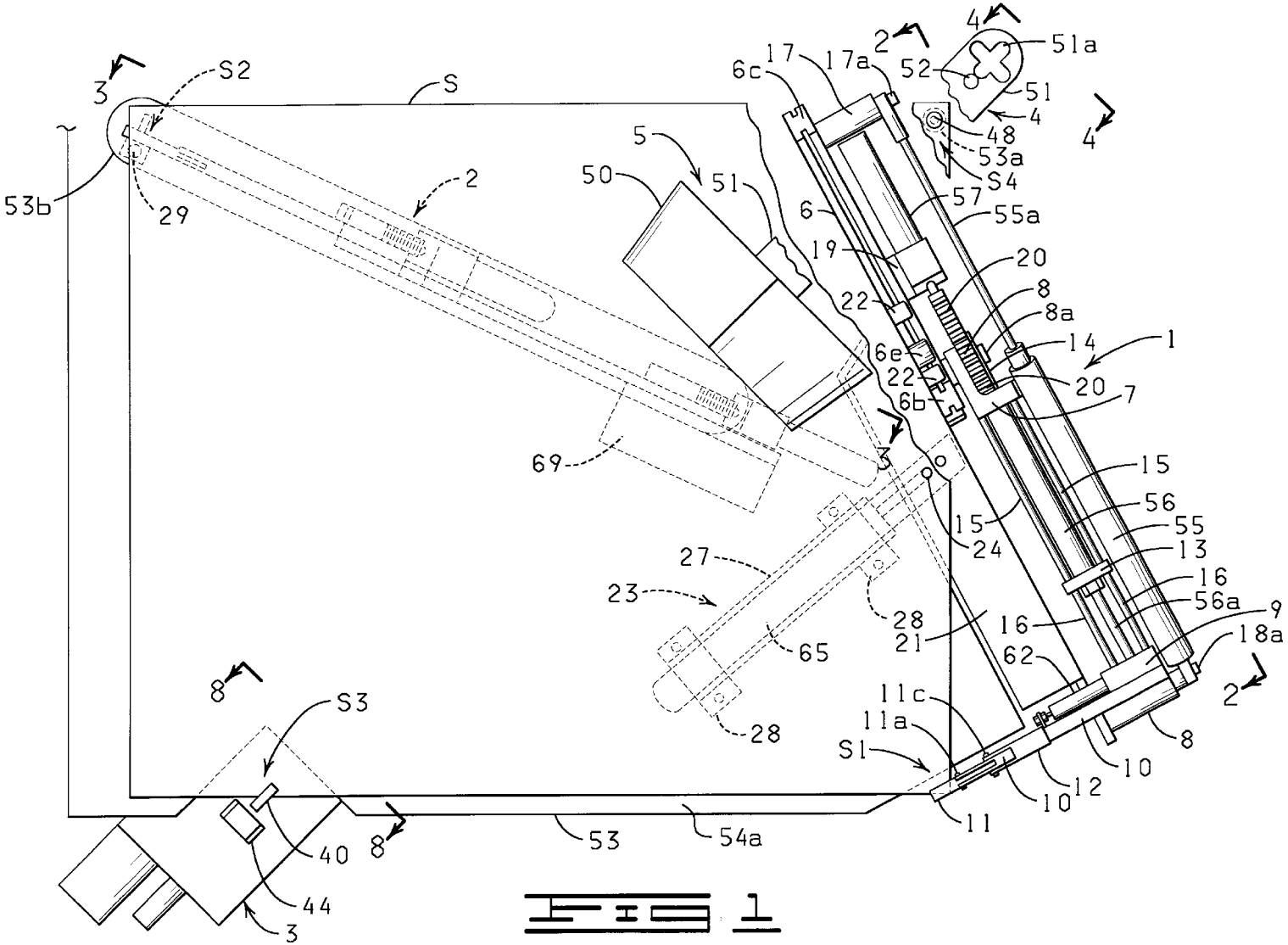
FIG. 1 is a plan view of a bouquet wrap machine according to the present invention.

FIG. 1 is a plan view of the bouquet wrapping machine showing a portion of a machine top 53 (also referred to herein as a support surface) which is mounted on a machine frame (not shown), and various subassemblies of the apparatus that are mounted on the machine top 53.

A right-hand wrap unit assembly 1 is generally positioned and operable from the right-hand side of a bouquet to be wrapped. A sheet of wrapping material S (also referred to herein as a sheet) of preselected size is positioned and clamped to machine top 53 adjacent each of the four corners S1, S2, S3 and S4 of the sheet S. In FIG. 1, a portion of the sheet S and a portion of the machine top 53 are removed so as to be able to view some of the components of the right-hand wrap unit assembly 1 which, in its initial position, lies below the level of a top surface 54*a* of machine top 53.

A left-hand wrap unit assembly 2 is shown in phantom lines in FIG. 1 to be positioned below the sheet S and, in its initial position, also at a level below the top surface 54*a* of machine top 53, as is the initial position of the right-hand wrap unit assembly 1. An elongated slat 53*b* is provided in machine top 53 to permit left-hand wrap unit assembly 2 to move therethrough and manipulate corner S2 of the sheet S.

A stem wrapper assembly 3 is positioned adjacent a stem end of the bouquet to be wrapped, and a fixed clamp assembly 4 functions to clamp the corner S4 in position as shown in the upper right-hand corner of the sheet S in FIG. 1.

A wrap ring form assembly 5, comprising a wrap ring support member 50, available in different sizes depending upon the size of bouquet to be wrapped, is positioned adjacent the corner S4 of sheet S. The wrap ring 50 is shown in the closed position in FIG. 1.

A slide assembly 23, also shown in phantom in FIG. 1, is mounted beneath the machine top 53 and serves the function of moving the right-hand wrap unit assembly 1 away from the wrapped bouquet at the end of the wrapping cycle.

The bouquet wrap apparatus of FIG. 1 is a self-contained machine for use with the preselected size sheet S of plastic film, clear or colored, painted or unpainted, printed or unprinted. The sheet S may be pre-cut sheets, or automatically dispensed from a roll dispenser which feeds a sheet of desired size to the proper working position on the machine top 53.

The basic operation of the apparatus is as follows. The sheet S is held down at or adjacent each corner S1–S4 by a hold down mechanism for each corner S1–S4, yet to be described in detail. It is sufficient at this point in the description to simply indicate that the four corners S1–S4 of sheet S are held or clamped by a pinch clamp 11 on corner S1 (also referred to herein as a first gripping unit), a vacuum cup 29 (also referred to herein as a second gripping unit) at corner S2, a pinch clamp 40 at corner S3, and a fixed clamp plunger 48 at corner S4. The wrap ring support member 50 of the wrap ring form assembly 5 then opens, as best seen by the phantom lines in FIG. 4, to accept a bundled bouquet with the stems of the bouquet directed to the corner S3 of the sheet S, and with the stems confined within a U-shaped stem holder 44. The bloom end of the bouquet is positioned within the wrap ring support member 50.

With the sheet S clamped at all four corners S1–S4 and the wrap ring support member 50 closed, the right-hand wrap unit assembly 1 rises to pull corner S1 of the sheet S up and around the bouquet to a position greater than 180° about the periphery of the bouquet, with the pinch clamp 11 coming to rest adjacent the periphery of the wrap ring support member 50 and toward the rear of the machine top 53. This completes the first part of the wrap cycle.

At, after, or before completion of the first part of the wrap cycle, the left-hand wrap unit assembly 2 carries the corner S2 of the sheet S up and about the bouquet to be wrapped and comes to rest with the vacuum cup 29 adjacent the periphery of wrap ring support member 50 toward the front of machine top 53. This second part of the wrap cycle obviously causes the corner S2 to overlap the sheet S by a substantial amount so that the portion of material between the outer surface of the sheet S adjacent corner S1 and the inner surface of the sheet S adjacent corner S2 is sufficient to provide a large overlapping contact area and, if desired, adequate adhesion or coadhesion between the two facing surfaces. The left-hand wrap unit assembly 2 manipulates the corner S2 in a path so as to first overlap the sheet S adjacent corner S1, but spaced therefrom, and then make contact between the overlapping portions of sheet S.

After completion of the second part of the wrap cycle by left-hand wrap unit assembly 2, the stem wrapper assembly 3 operates to tightly wrap the corner S3 of the sheet S tightly about the stem portion of the bouquet.

After adhesion, coadhesion, heat sealing, sonic sealing, vibratory sealing, elastic banding, nonelastic banding, or the like to keep the wrapped bouquet secure, the pinch clamps 11 and 40, vacuum cup 29 and fixed clamp plunger 48 are released, slide assembly 23 operates to push the right-hand wrap unit assembly 1 away from machine top 53, and both right- and left-hand wrap unit assemblies 1 and 2 retract to beneath machine top 53. The operator then removes the wrapped bouquet, stems first, completing the cycle.

The operation of the right-hand wrap unit assembly 1 will now be described in detail with reference to FIGS. 1, 1A, 1B, and 2. A rocker arm 6 having a "C" shape and an H-shaped cross section is confined to move along the periphery of a circular path the center of which is the center of an imaginary circle having a segment of its periphery defining the C-shape of the rocker arm 6. In its initial position, rocker arm 6 is located beneath machine top 53 as shown by solid lines in FIG. 2. Ends 6b and 6c of rocker arm 6 are cut at an angle so as to not interfere with the sheet S positioned on machine top 53. A pair of rollers 6*d* and 6*e* confine the movement of rocker arm 6 to the aforementioned circular path by rolling against a circular outer periphery 6*f* and a circular inner surface 6*a*, respectively, of the rocker arm 6. Aiding in confining the rocker arm 6 to its circular path are a number of rocker support clips 22, each having a tab (not shown) which slidably fits within one of the edge slots on either side of the rocker arm 6, the slots defined by the H-shaped cross section of rocker arm 6.

A right-hand unit angle mount 21 supports the entire mechanism of right-hand wrap unit assembly 1. Right-hand unit angle mount 21 mounts the operational parts of right-hand wrap unit assembly 1 on its vertically oriented portion, and the horizontal portion of right-hand unit angle mount 21 is securely affixed to the end of a slide member 27, so that right-hand wrap unit assembly 1 can be moved to the right (in FIG. 1) after completion of the wrap cycle.

Figures 1A, 1B, 2:
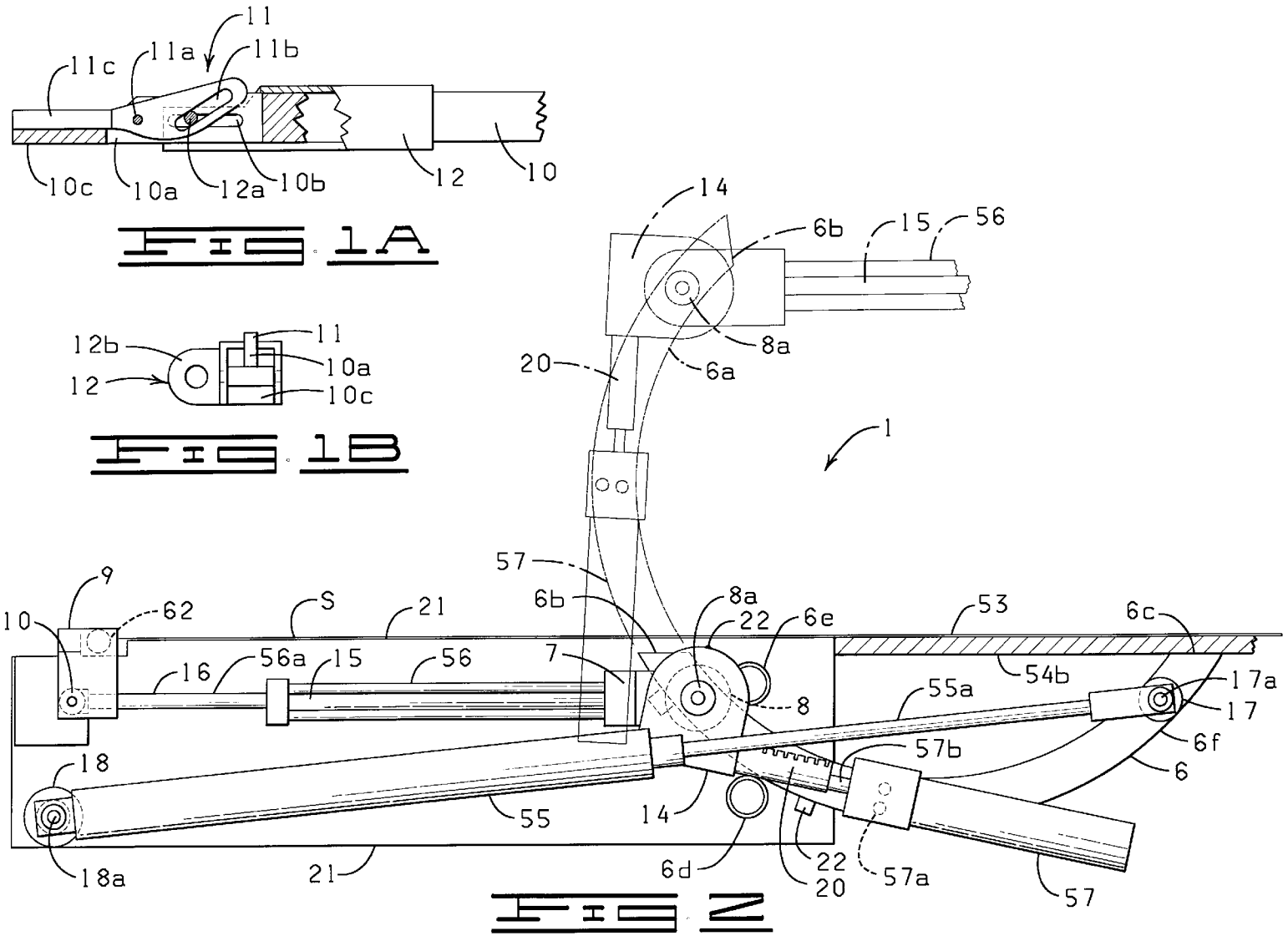
FIG. 1A is a partial cross-sectional view of a pinch clamp for holding and manipulating one corner of a sheet of wrapping material.
FIG. 1B is a left elevational view of the pinch clamp shown in FIG. 1A.
FIG. 2 is a side elevation view taken along line 2—2 in FIG. 1 showing the components of a right-hand wrap unit assembly.

Fixed to the right-hand unit angle mount 21 is a pivot pin 18*a* about which a rocker cylinder pivot standoff 18 is positioned to locate a rocker cylinder 55 spaced from other components of right-hand wrap unit assembly 1 and permit rocker cylinder 55 to pivot about the pivot pin 18*a*. Rocker cylinder 55 is shown as a pneumatic or hydraulic piston cylinder which reciprocates a piston shaft 55*a* having its distal end pivoted about a pivot pin 17*a* and spaced from rocker arm 6 by a rocker arm standoff 17. Pivot pin 17*a* is fixed to a far right-hand end of rocker arm 6 as shown in FIG. 2. Operation of rocker cylinder 55 causes the piston shaft 55*a* to either pull or push against pivot pin 17*a* and effect movement of rocker arm 6 along the aforementioned circular path. In the fully closed position of piston shaft 55*a*, rocker arm 6 will have the position shown by dashed lines in FIG. 2.

For ease in discussing the operation of the various active elements of the invention, the term "cylinder" as used hereinafter will refer to a pneumatic or hydraulic cylinder or any other mechanism which is capable of applying reciprocal motion to an object. Each of these types of elements is depicted in the drawings as pneumatic cylinders.

Before operation of the rocker cylinder 55 to raise the right-hand wrap unit assembly 1, the corner S1 of sheet S is clamped by the pinch clamp 11, the details of which are best seen in FIGS. 1A and 1B. The side view of the pinch clamp 11 in FIG. 1A shows a right-hand clamp arm 10 affixed to a right-hand cushion cylinder head 9 (see FIG. 1) which, in turn, is fixed to the end of a piston shaft 56*a* and cushion cylinder slide rods 16. The end of pinch clamp 11 is flattened to form an upper jaw 11*c*. A free end of right-hand clamp arm 10 is narrowed and flattened to form a lower jaw 10*c* of the pinch clamp 11. A slot 10*a* near the end of right-hand clamp arm 10 permits the vertically oriented thinned portion of pinch clamp 11 to move within slot 10*a* (FIG. 1B). The pinch clamp 11 is pivoted about a pin 11*a* fixed to the right-hand clamp arm 10 and has a slot 11*b* angled with respect to a cooperating slot 10*b* in right-hand clamp arm 10. A pin 12*a* passes through slots 10*b* and 11*b* and is fixed to each side of a U-shaped clamp actuator 12. A tab 12*b* of the U-shaped clamp actuator 12 is reciprocated by action of a clamp cylinder 62. As tab 12*b* is reciprocated, the U-shaped clamp actuator 12 reciprocates and causes the lower and upper jaws 10*c* and 11*c*, respectively, to open and close, depending upon whether the movement of the U-shaped clamp actuator 12 is to the right or left in FIG. 1A. In the open position of the pinch clamp 11, the sheet S can be moved into its predetermined position for clamping, and at the beginning of the wrap cycle, the clamp cylinder 62 operates to close the lower and upper jaws 10*c* and 11*c* to clamp the corner S1 of the sheet S therebetween.

With the material clamped by pinch clamp 11, the rocker cylinder 55 is operated to retract piston shaft 55*a* into rocker cylinder 55. This pulls pin 17*a* to the left in FIG. 2 and moves rocker arm 6 in a circular path as previously described.

Near the left end of rocker arm 6, a pivot pin 8*a* passes through a swing gear guard 14, a pinion gear 8, and a swing block 7, all of such components being fixed to rocker arm 6 by the pivot pin 8*a* (which may be a screw). A right-hand swing cylinder 57 is fixed to the approximate center of rocker arm 6 by screws 57*a* and carries a rack 20 at the end of a piston shaft 57*b*. The rack 20 has a system of teeth which mesh with and cooperate with the teeth of pinion gear 8 affixed or keyed to swing block 7, such that movement of the piston shaft 57*b* effects rotation of pinion gear 8 by the reciprocal motion of rack 20 at the appropriate times in the wrap cycle. Thus, when the rocker cylinder 55 retracts piston shaft 55*a*, pivot pin 8a begins to rise in the path illustrated in FIG. 2, resulting in a swinging movement of the elements connected to rocker arm 6, including a right-hand cushion cylinder 56 and, in turn, right-hand clamp arm 10 with the corner S1 of the sheet S clamped thereto.

At the beginning of the operation of right-hand wrap unit assembly 1, the right-hand swing cylinder 57 is not activated and has piston shaft 57*b* fully retracted. This permits right-hand cushion cylinder 56 to lie relatively flat beneath the machine top 53 and extending to the left in FIG. 2. As the rocker cylinder 55 retracts piston shaft 55*a*, swing block 7, which supports right-hand cushion cylinder 56, moves upwardly as rocker arm 6 follows its circular path.

At a prescribed position of the rocker arm 6, the right-hand swing cylinder 57 begins to force piston shaft 57*b* outwardly rotating pinion gear 8, by the action of rack 20, in a clockwise direction as seen in FIG. 2. Since pinion gear 8 is fixed or keyed to swing block 7, right-hand cushion cylinder 56 rotates clockwise as well, pivoting about the pivot pin 8*a*. In this manner, the corner S of the sheet S is first brought upwardly and then the sheet S begins to wrap about the bouquet with the interior portion of the S sheet forming around wrap ring support member 50.

This contact of the sheet S with the wrap ring support member 50, in effect, limits the upward movement of the sheet S so that the diameter of the swing of right-hand wrap unit assembly 1 must necessarily be reduced; otherwise, the corner S1 would slip out of pinch clamp 11, or it would tear. This is accomplished by the operation of right-hand cushion cylinder 56 and right-hand swing cylinder 57, the former causing the radius of the swing movement to directly decrease as a result of the retraction of piston shaft 56*a* into the right-hand cushion cylinder 56 and telescopic retraction of cushion cylinder slide rods 16 within cushion cylinder fixed rods 15 which provide strength and stability to the operation of the right-hand cushion cylinder 56. Operation of the right-hand swing cylinder 57 brings the right-hand clamp arm 10 down into position against the far side of wrap ring support member 50, i.e. to a position greater than 180° about the periphery of the bouquet, to complete the first part of the wrap cycle.

Figures 3, 3A:
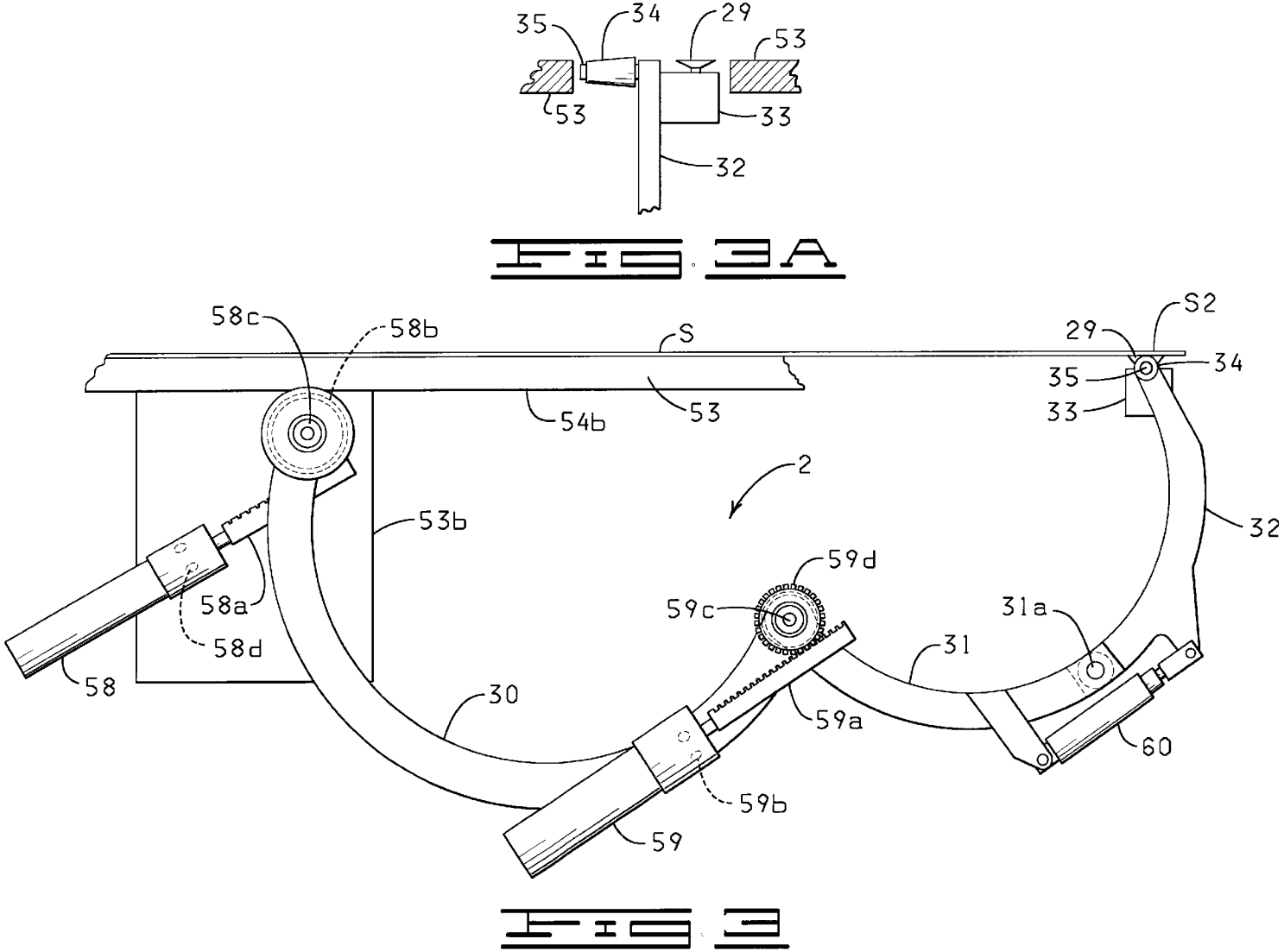
FIG. 3 is a side elevation view taken along line 3—3 in FIG. 1 and showing the components of a left-hand wrap unit assembly.
FIG. 3A is a partial right end view of the left-hand wrap unit assembly of FIG. 3.

Toward the end of the first part of the wrap cycle, or after completion thereof, as desired, the left-hand wrap unit assembly 2 begins to function (see FIG. 3).

At the start of the next part of the wrap cycle, the left-hand wrap unit assembly 2 is entirely located beneath the machine top 53. Cylinders 58, 59, and 60 are in retracted positions, and the vacuum cup 29 is located substantially level with the top surface 54*a* of machine top 53.

The left-hand wrap unit assembly 2 is comprised primarily of a pair of C-shaped swing arms, including a main swing arm 30 and a secondary swing arm which has a secondary swing arm stub portion 31 extending to a cushion arm 32 having the vacuum cup 29 attached to a free end thereof. Secondary swing arm stub portion 31 is pivotally attached to cushion arm 32 by a pivot member 31*a*, and relative pivotal movement between the secondary swing arm stub portion 31 and the cushion arm 32 is effected by the operation of cylinder 60.

FIG. 3*a* shows the end of cushion arm 32 having a conical roller 34 rotatable about a roller mount screw 35 on one side thereof, and a vacuum cup holder 33 with vacuum cup 29 positioned on the opposite side. A vacuum pump (not shown) is connected to vacuum cup 29 after the sheet S is in position on machine top 53 and the wrapping procedure is ready to begin. In operation, a vacuum is applied to vacuum cup 29 to hold the corner S2 of the sheet S in place even before the actuation of the right-hand wrap unit assembly 1.

At the appropriate time in the wrapping sequence, cylinder 58 is actuated to extend a rack 58*a* attached thereto. Cylinder 58 is mounted by screws 58*d* to left-hand swing arm elongated slat 53*b* which is attached to a bottom surface 54*b* of machine top 53. As rack 58*a* moves outwardly from cylinder 58, a pinion gear 58*b* fixed or keyed to the left end of main swing arm 30, begins to rotate about a shaft 58*c*. This causes the entire left-hand wrap unit assembly 2 to begin swinging upwardly about the shaft 58*c*, resulting in the vacuum cup 29 carrying corner S2 of the sheet S up and about the bouquet to be wrapped.

It will be appreciated that an inner surface of the corner S2 of the sheet S may have an adhesive or coadhesive which will adhere to an outer surface of the corner S1 of the sheet S in the overlapping area of the final configuration. Accordingly, it is not advisable to drag the material across previously wrapped material, since premature attachment of the overlapping portions of the sheet S would occur. Positioning the main swing arm 30, secondary swing arm stub portion 31 and cushion arm 32 so as to have the fullest extent possible keeps the corner S2, and the adjacent portion of the sheet S, well away from the previously wrapped portion.

As the left-hand wrap unit assembly 2 rises and brings corner S2 over the previously wrapped portion of the bouquet, at a prescribed position cylinder 59, mounted to the main swing arm 30 by screws 59*b*, begins to push a rack 59*a* outwardly. As it does, pinion gear 59*d*, fixed or keyed to a left end of secondary swing arm stub portion 31, begins to rotate about a shaft 59*c*. This reduces the diameter of the swing arm movement and begins to bring the corner S2 of the sheet S closer to the partially wrapped bouquet, such action providing the same benefits as that previously described in connection with the radius-reducing action of the right-hand wrap unit assembly 1. In the instant case, however, an additional feature is provided in the form of conical roller 34 which is shaped and positioned to meet with and roll against the conforming conical surface of wrap ring support member 50 near the completion of the wrap cycle.

Just before the completion of the wrap cycle, the cylinder 60 extends to move the free end of cushion arm 32 closer to the wrap ring support member 50 so that conical roller 34 can positively and firmly roll against the wrap ring support member 50. Also, the last movement of the free end of cushion arm 32 brings the sheet S into intimate contact with the previously partially wrapped bouquet so that the two portions of the overlapping sheet S can be adhered to one another without dragging the sheet S across itself at the end of the wrapping procedure.

Figure 4:
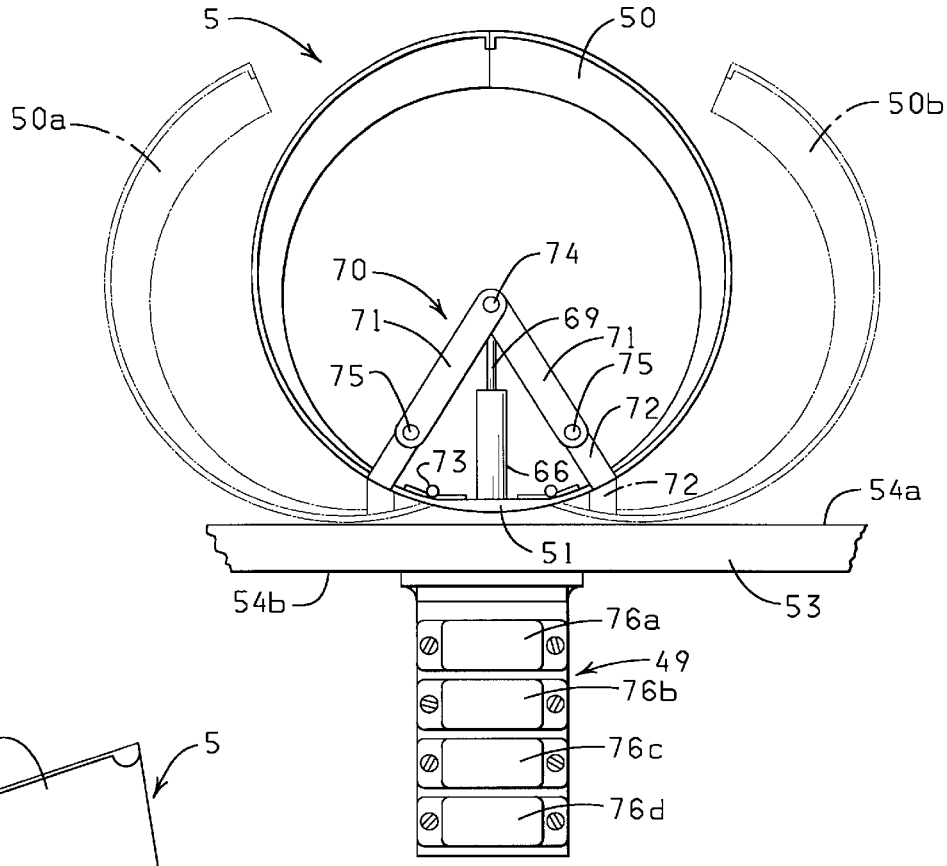
FIG. 4 is an end view of a wrap ring member, in both open and closed positions, taken along line 4—4 in FIG. 1, with some parts removed so as not to obscure the wrapping function.
Figure 5:
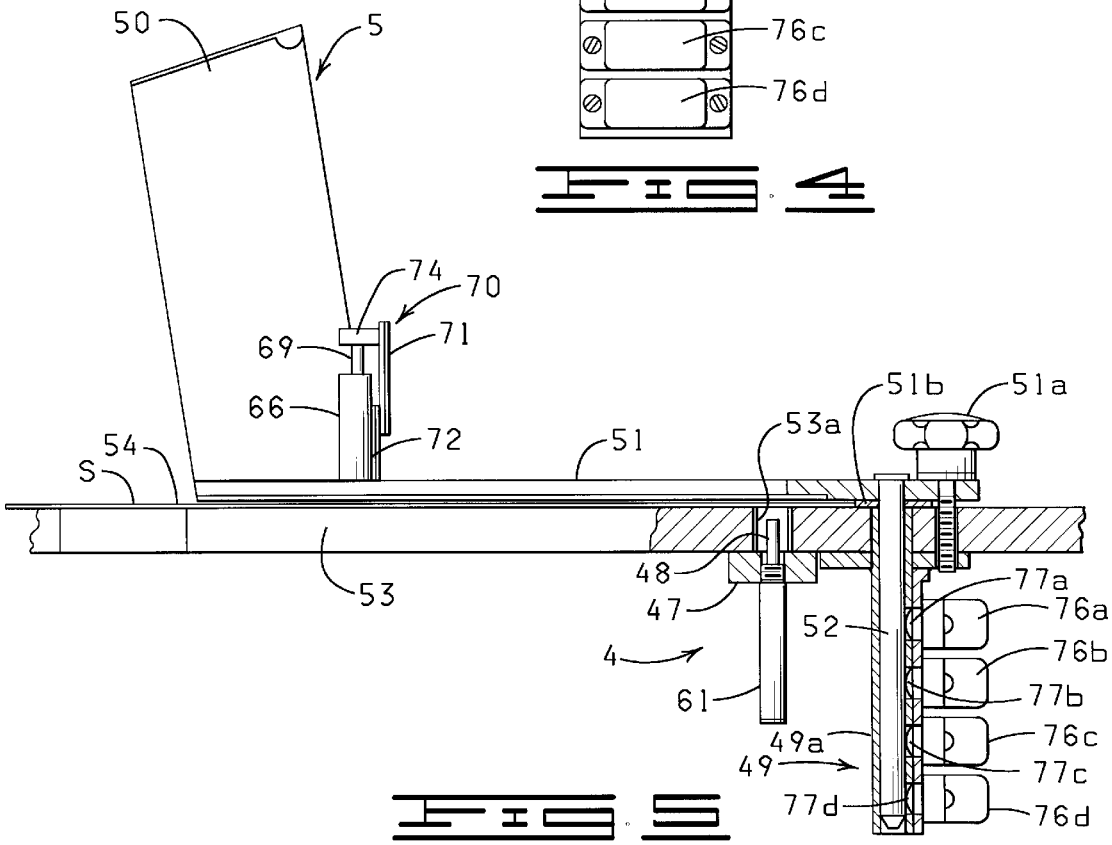
FIG. 5 is a right elevation view of the wrap ring member shown in FIG. 1.
Figure 3:
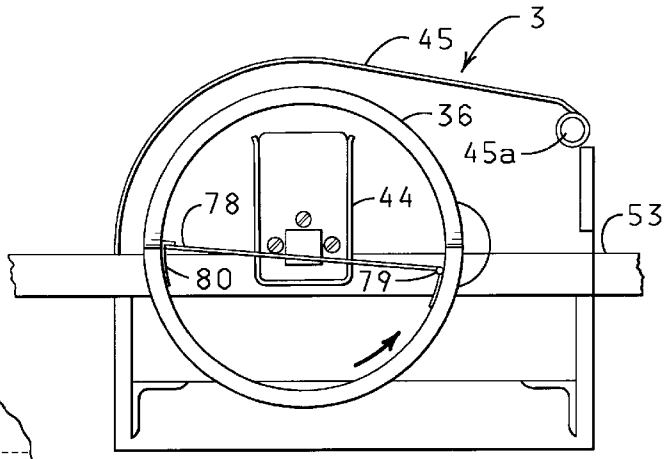
Figure 5:
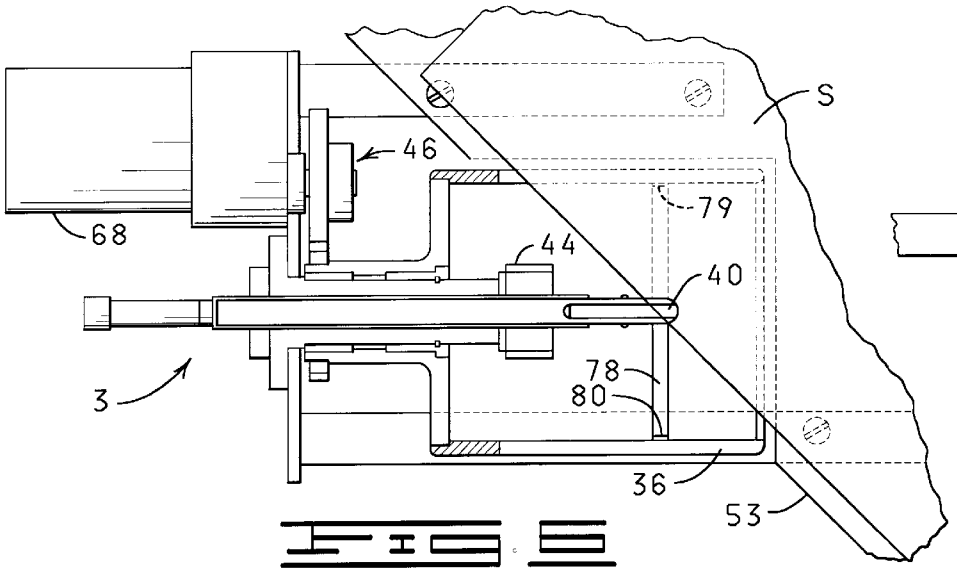

FIGS. 4 and 5 will now be described, these figures showing the wrap ring form assembly 5 in more detail. FIG. 4 is a view taken along line 4—4 in FIG. 1 except that some components have been removed from what actually would be viewed from that location so as not to obstruct the view of a wrapping cylinder actuator 70 which is best seen in FIG. 4.

As previously indicated, at the beginning of the first portion of the wrap cycle, the wrap ring support member 50 opens to allow a bouquet to be inserted with the bloom end oriented toward the wrap ring support member 50. The wrap ring support member 50 comprises two halves, wrap ring half 50*a* and wrap ring half 50*b*, the bottoms of which are connected to a wrap ring linkage 51 by hinges 73. Also mounted on wrap ring linkage 51 is the cylinder portion of a wrap ring cylinder 66 having a piston shaft 69 reciprocating within wrap ring cylinder 66. Mounted to the end of piston shaft 69 is an elongated pivot rod 74 which provides a pivot axis for two links 71 which have upper ends pivoted to a common pivot axis at pivot rod 74 and lower ends separately pivotable about pivot pins 75 at upper ends of a pair of standoffs 72 welded or otherwise fixed to the respective wrap ring halves 50*a* and 50*b*.

As can be seen in FIG. 4, the solid lines show the wrap ring support member 50 in a closed position due to the fact that the piston shaft 69 is fully extended from wrap ring cylinder 66. When piston shaft 69 is retracted into wrap ring cylinder 66, pivot rod 74 is moved downwardly, and ultimately standoffs 72 assume a substantially vertical position as shown in dashed lines in FIG. 4. In this condition, the wrap ring support member 50 is in its fully open position. Also shown in dashed lines in FIG. 4 is the position of the two wrap ring halves 50*a* and 50*b* in the fully open position.

Below machine top 53 is a ring pin receiver 49 upon which is mounted a number of electrical microswitches 76*a*–76*d*. Each electrical microswitch 76*a*–76*d* is operated by the pushing of an associated switch button 77*a*–77*d* on each electrical microswitch 76*a*–76*d*.

A wrap ring pin 52 is fixed to the wrap ring linkage 51 and has a length which is predetermined by the size of the wrap ring support member 50. That is, the invention is able to accommodate a variety of sizes of bouquets to be wrapped, and for each size wrap, in order to obtain the optimum wrapping for a pleasing appearance and security, the wrap ring support member 50 must be a different size as well. By way of example, and without limitation, the wrap ring support member 50 may accommodate bouquets having a bloom diameter of 4", 5", 6" and 8". For a 4" bouquet, the wrap ring pin 52 would be of a length sufficient to only operate switch button 77*a* on electrical microswitch 76*a*. This sets the electrical circuit which operates the right-hand and left-hand wrap unit assemblies 1 and 2 so as to establish the required path and timing and to manipulate the sheet S in an optimum manner to produce a secure and pleasing wrapped bouquet product. The effects of operating one or more of electrical microswitches 76*a*–76*d* will be explained later.

When wrap ring form assembly 5 is removed and another sized wrap ring form assembly 5 is to be substituted, a lock-down screw 51*a* is loosened, wrap ring linkage 51 is grasped, and the wrap ring form assembly 5 is raised, thereby withdrawing wrap ring pin 52 from a sleeve 49*a*. The replacement wrap ring assembly 5 is then installed by inserting the wrap ring pin 52 into sleeve 49*a* and tightening the lock-down screw 51*a*. In the embodiment illustrated, if the replacement wrap ring assembly 5 is for wrapping a 5" bouquet, the wrap ring pin 52 would be of a length to operate electrical microswitches 76*a* and 76*b*. For a 6" bouquet, electrical microswitches 76*a*–76*c* are operated, and for an 8" bouquet, all electrical microswitches 76*a*–76*d* are operated. An appropriate circuit (not shown) is responsive to the four different electrical responses to set up the required path and timing which are optimum for the different sized bouquets to be wrapped.

As can be appreciated by reference to FIG. 5, the wrap ring support member 50 is suspended above the machine top 53 to permit a sheet S to slide between wrap ring linkage 51 and the top surface 54*a* of the machine top 53. Wrap ring linkage 51 is rigidly held in the suspended position by means of lock-down screw 51*a* which is screwed into machine top 53 until wrap ring linkage 51 is clamped securely against a spacer washer 51*b* which surrounds the wrap ring pin 52. Wrap ring pin 52 is further secured into cooperative relationship with switch buttons 77*a*–77*d* by means of sleeve 49*a* which has an inside diameter just slightly larger than the outside diameter of the wrap ring pin 52. Sleeve 49*a* is also secured to the machine top 53.

FIG. 5 also best shows the operation of the fixed clamp assembly 4 which comprises a fixed clamp cylinder 61 screwed into a fixed clamp cylinder mount 47 attached to the bottom surface 54*b* of machine top 53. An opening 53*a* is provided in the machine top 53 so as to permit the fixed clamp plunger 48 of the fixed clamp assembly 4 to reciprocate within the fixed clamp cylinder 61. Upon extension of the fixed clamp plunger 48 upwardly (in FIG. 5), the sheet S will be clamped against the bottom of wrap ring linkage 51 to hold the sheet S in place during the entire wrapping operation. The fixed clamp cylinder 61 is de-energized at the conclusion of the wrap cycle so that the completely wrapped bouquet can be easily removed from the assembly.

Figure 7:
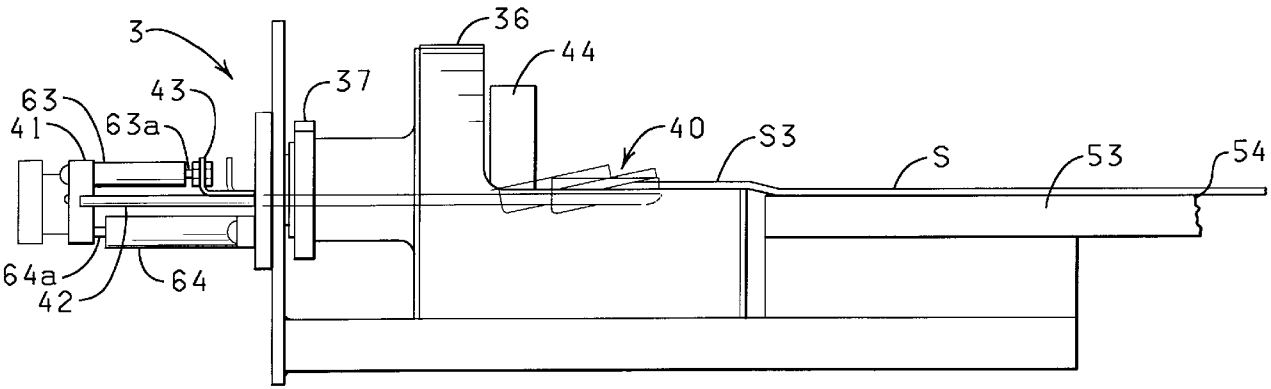
FIG. 7 is a side elevation view of the bouquet stem wrapping unit of FIG. 6.
Figure 5A:
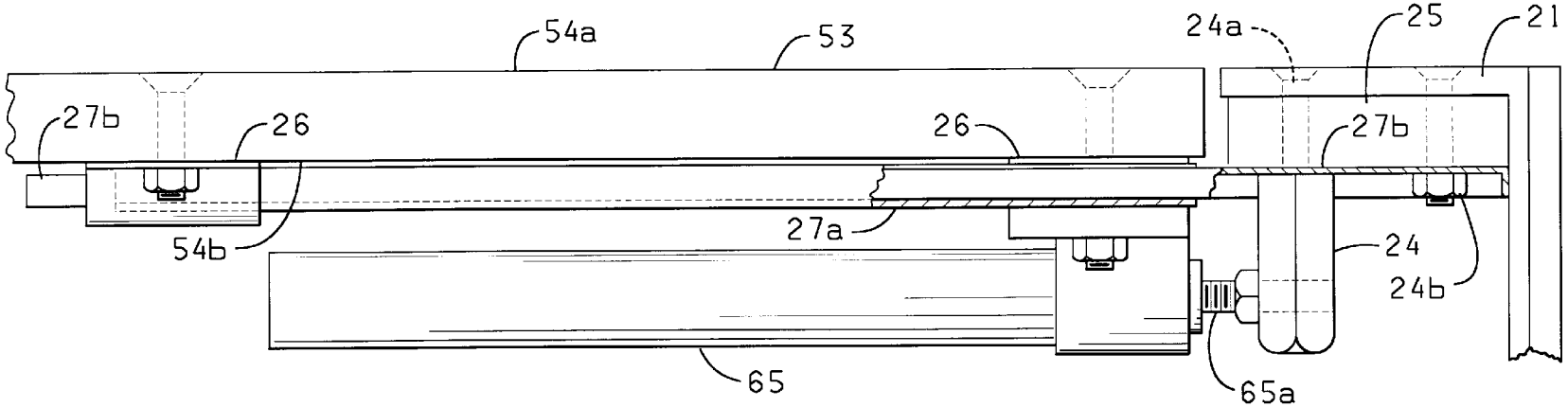
Figure 5B:
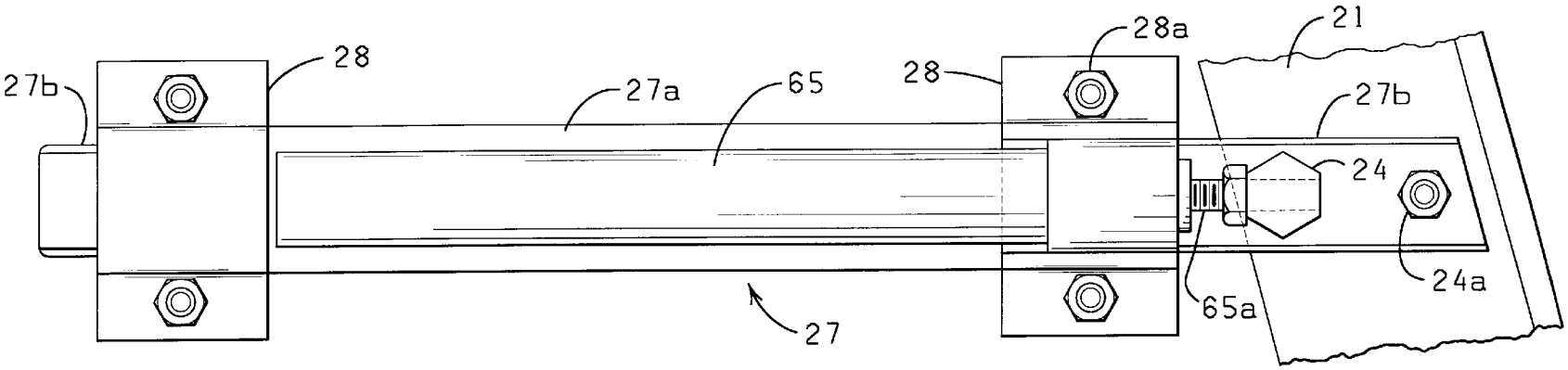

FIGS. 6–8 show the operation of the stem wrapper assembly 3. FIG. 6 is the view from the top of the apparatus, FIG. 7 is a side elevation view, and FIG. 8 is an end view as would be seen by the stem portion of the bouquet to be wrapped. Basically, the stem wrapper assembly 3 comprises a motor 68 (turning at 154 RPM) driving a gear assembly 46 and a gear assembly 37 which rotates a half cylinder shaped stem wrapper 36, and pinch clamp 40 which extends within the center of the half cylinder shaped stem wrapper 36.

Before the beginning of the wrap cycle, pinch clamp 40 is retracted to the left as shown in dashed lines in FIG. 6 by the action of a wrapper clamp slide cylinder 64 pushing a piston 64*a* therefrom. Also, a wrapper clamp cylinder 63 has a piston 63*a* retracted as shown in solid lines in FIG. 7, which pulls to the left the tab of a wrapper clamp actuator 43, thereby opening the jaws of pinch clamp 40. The operation of the wrapper clamp cylinder 63 and pinch clamp 40 is very similar to that described in connection with FIG. 1 where the operation of the clamp cylinder 62 is detailed. Accordingly, no additional operating functions are necessary to be explained at this juncture except to indicate that the wrapper clamp cylinder 63 is mounted to a wrapper clamp cylinder mount 41 which reciprocates axially of the half cylinder shaped stem wrapper 36 by the action of wrapper clamp slide cylinder 64. Accordingly, the wrapper clamp slide cylinder 64 operates to move the entire pinch clamp 40 toward and away from the edge of the sheet S, while the wrapper clamp cylinder 63 operates to close and open the jaws of pinch clamp 40.

Thus, before the wrap cycle begins, the wrapper clamp slide cylinder 64 has its piston shaft 64a extended to move the wrapper clamp cylinder mount 41 to the left (in FIG. 7), and the wrapper clamp cylinder 63 has its piston shaft 63*a* withdrawn so as to pull wrapper clamp actuator 43 to the left, opening the jaws of pinch clamp 40. After a sheet S is placed on machine top 53 and the corner S3 is slipped over the edges of the half cylinder shaped stem wrapper 36, the wrapper clamp slide cylinder 64 is actuated to move a wrapper clamp arm 42 and the wrapper clamp cylinder mount 41 to the right, resulting in the pinch clamp 40 positioned with its opened jaws receiving corner S3 of the sheet S. Subsequently, the wrapper clamp cylinder 63 is actuated to extend its piston shaft 63*a* to cause wrapper clamp actuator 43 to close the jaws of pinch clamp 40 and clamp the corner S3 of the sheet S in place.

FIG. 8 shows an optional stem wrapper safety cover 45 which is hinged at hinge 45*a* by any manner of hinging to machine top 53. In this way, the operation of the stem wrapper assembly 3 can be completed without exposure of the rotating the half cylinder shaped stem wrapper 36 which could be a threat to the safety of the operator.

After the sheet S is deposited on the top surface 54*a* of machine top 53, the jaws of pinch clamp 40 clamp the corner S3 into position, the wrap ring support member 50 opens and the bouquet of flowers to be wrapped is placed on the top of sheet S with the stems contained within the U-shaped stem holder 44. The stem wrapper safety cover 45 is then closed, and the operator initiates the wrapping cycle. At the appropriate point in the wrapping cycle, gear assembly 46 rotates wrapper gear 37 to, in turn, rotate the half cylinder shaped stem wrapper 36 in the direction of the arrow shown in FIG. 8.

In FIG. 8, the position of the half cylinder shaped stem wrapper 36 is shown in the orientation just prior to the wrapping operation. After the first and second halves of the wrapping cycle are completed by the right-hand and left-hand wrap unit assemblies 1 and 2, or just prior to such completion, the half cylinder shaped stem wrapper 36 beings to rotate counterclockwise as seen in FIG. 8.

A relatively strong leaf spring 78 is mounted at one of its ends by a leaf spring mount 79 to the inside surface of the half cylinder shaped stem wrapper 36. Leaf spring 78 is pretensioned to apply a force upwardly at its left free end as shown in FIG. 8. Leaf spring 78, however, is prevented from having its left end move upwardly by the provision of a stop 80 also mounted to the inside surface of the half cylinder shaped stem wrapper 36 diametrically opposite the leaf spring mount 79. This construction permits the leaf spring 78 to be pushed in a counterclockwise direction when the force against it, during the wrapping operation, exceeds its spring force tending to push it against stop 80.

When the stems of the bouquet to be wrapped are placed in U-shaped stem holder 44, the stems at the bottom of the bouquet rest against a top surface of leaf spring 78, since the bottom of the U-shaped stem holder 44 is located beneath leaf spring 78. At the appropriate time, near or after the sheet S is wrapped around the bouquet, motor 68 begins to rotate to, in turn, rotate the half cylinder shaped stem wrapper 36 in a counterclockwise direction. With the stems of the bouquet captured between the walls of U-shaped stem holder 44, leaf spring 78 applies a strong spring force against the sheet S to press it tightly against the stem portion of the bouquet. Since the bouquet itself is being held stationary, and since the sheet S has been fully wrapped around the bouquet, the half cylinder shaped stem wrapper 36 adds security to the wrapped bouquet by pressing the sheet S tightly against the stem portion of the bouquet.

If the portion of the sheet S has an adhesive coating on it at the location of the half cylinder shaped stem wrapper 36, the leaf spring 78 will create overlapping folds which maintain their pressed condition due to the adhesive and to the applied pressure by leaf spring 78 as the half cylinder shaped stem wrapper 36 rotates about the stem portion of the bouquet.

In a preferred embodiment of the invention, the half cylinder shaped stem wrapper 36 rotates two times about the stem portion of the bouquet and comes to a stop in the same position as its starting position to allow the bouquet to be easily removed from the apparatus by raising the stem wrapper safety cover 45 and simply removing the bouquet by an upward movement, stems first. Of course, by this time, i.e. after completion of the number of turns that the half cylinder shaped stem wrapper 36 makes, the wrapper clamp cylinder 63 retracts its piston shaft 63*a*, and the wrapper clamp slide cylinder 64 extends its piston shaft 64*a* to release the sheet S from moving the jaws of the pinch clamp 40. Before or after removal of the bouquet from the apparatus, the sheet S may be maintained about the bouquet or floral grouping using an elastic or nonelastic band, a decorative tie, adhesives and cohesives, ribbons, ribbons with adhesive, bows, stickers which can be decorative and/or informative or simply plain, tapes, heat sealing, sonic sealing and welding, wire ties, tie wraps, curl film, deadfold plastic ties, dead-fold wrapping material in part or in whole, or other banding and/or bonding material.

Prior to removal of the completely wrapped bouquet, the right-hand and left-hand wrap unit assemblies 1 and 2 will still be in the vicinity of the wrap ring support member 50 with corners S1 and S2 still being held by the pinch clamp 11 and the vacuum cup 29.

The vacuum cup 29 can be easily released by simply relieving the negative pressure applied to the vacuum cup 29 and retracting the left-hand wrap unit assembly 2 in the reverse order of cylinders 58, 59, and 60, hereinbefore described. However, the pinch clamp 11 of the right-hand wrap unit assembly 1, even though released, may still interfere with the sheet S if the sheet S is much larger than the bouquet being wrapped leaving a large skirt portion extending beyond the wrap ring support member 50. To prevent interference of the right-hand wrap unit assembly 1 with the sheet S of the wrapped bouquet at the completion of the wrapping cycle, slide assembly 23 is screw-mounted to the bottom surface 54*b* of the machine top 53. The slide assembly 23 is shown in phantom lines in FIG. 1 as it would be viewed from the top of the apparatus, from the side in FIG. 9A, and from the bottom as in FIG. 9B.

The slide assembly 23 basically comprises a slide member 27, similar to that of a furniture drawer slide, and an actuator. The slide member 27 itself is comprised of a U-shaped outer channel member 27*a* and a U-shaped inner channel member 27*b* which slides within the U-shaped outer channel member 27*a* in a manner known in the furniture art. Appropriate bearings (not shown) may be provided to assist in reducing the friction in the extension and retraction directions of the slide movement.

In the instant case, the U-shaped outer channel member 27*a* is fixed and mounted to the underside of machine top 53 by slide mount spacers 26, slide mounts (forward and rear) 28, and bolt and nut combinations 28*a*.

At the free end of the U-shaped inner channel member 27*b*, a slide cylinder rod mount 24 is rigidly mounted by means of a bolt 24*a* passing through a hole in right-hand unit angle mount 21 and through a U-shaped inner channel member spacer 25. For security, a second bolt 24*b* is shown to secure right-hand unit angle mount 21 to the distal end of the U-shaped inner channel member 27*b*.

The entire slide assembly 23 is mounted at an angle to the longitudinal direction of right-hand unit angle mount 21, the angle being chosen to move the pinch clamp 11 away from the wrapped bouquet and along a line which would pass through the location of pinch clamp 11 and would lie against the surface of the wrapped conical-shaped bouquet. Since the pinch clamp 11 comes to rest at the end of the wrapped cycle on the far side of wrap ring support member 50, the direction of movement of the entire right-hand wrap unit assembly 1 by the action of slide member 27 is substantially in line with the material lying on the far side of the bouquet.

Also mounted to the bottom surface 54b of machine top 53, and taking advantage of the mounting screws already provided for fixing the U-shaped outer channel member 27*a* to the bottom surface 54*b* of machine top 53, is a slide cylinder 65. The slide cylinder 65 actuates a piston 65*a* which has its operating end attached to slide cylinder rod mount 24. It can be appreciated that all of the elements of the right-hand wrap unit assembly 1 are mounted on right-hand unit angle mount 21 which is rigidly mounted to the end of U-shaped inner channel member 27*b*. Therefore, as piston 65*a* moves out of and into the slide cylinder 65, the entire right-hand wrap unit assembly 1 moves away and toward the machine top 53. As with all of the other elements which move during the wrapping process, the timing of the slide movement is electronically controlled to be effective at the appropriate time in the wrap cycle.

The timing of the complete wrap cycle will now be described. It should be appreciated that, prior to the start of the operation, the appropriate sized wrap ring support member 50 will have been chosen so as to select the appropriate number of electrical microswitches 76*a*–76*d* that will be activated by the wrap ring pin 52 which thereby sets the proper electrical parameters and timing for the ensuing operations.

First, a preselected sized sheet of plastic film, clear or colored, painted or unpainted, printed or unprinted, adhesive coated or not, is selected from a stack of pre-cut sheets S or automated with a dispenser which feeds a sheet S from a roll to the proper working position on the machine top 53. With the sheet S in place, an operator pushes a start button (not shown). The sheet S is then clamped at all four corners S1–S4 by extending and closing pinch clamp 11 at corner S1, by applying negative pressure to the vacuum cup 29 at corner S2, by movement of pinch clamp 40 toward the sheet S and then clamping the sheet S at corner S3, and by actuating the fixed clamp cylinder 61 to cause the fixed clamp plunger 48 to press corner S4 against the bottom of wrap ring linkage 51. At substantially the same time, the wrap ring cylinder 66 retracts to open wrap ring support member 50 so as to be able to receive a bouquet of flowers. Thus, with the appropriate sized wrap ring support member 50 in place, the stem wrapper safety cover 45 is opened and a bouquet is placed with the flowers in the wrap ring support member 50 and the stems in the U-shaped stem holder 44 in stem wrapper assembly 3.

The operator then closes the stem wrapper safety cover 45 over the stems and pushes another button (not shown) to start the wrapping cycle.

The wrap ring form assembly 5 closes by the extension of the wrap ring cylinder 66 and the right-hand wrap unit assembly 1 carries the right-hand side of the sheet S to wrap around the bouquet and wrap ring support member 50 from right to left. Then, the left-hand wrap unit assembly 2 carries the left side of the sheet S to wrap from left to right, and finally the stem wrapper assembly 3 tightens the sheet S about the stems of the bouquet. At the conclusion of the wrap cycle, the corders S1–S4 are released in the manner previously described, slide assembly 23 slides right-hand wrap unit assembly 1 away from the wrapped bouquet, the right- and left-hand wrap unit assemblies 1 and 2 retract to their initial position, and the operator lifts the stem wrapper safety cover 45 and removes the wrapped bouquet, stems first, by pulling the wrapped stem portion away from wrap ring support member 50, thereby pulling the bloom end of the wrapped bouquet through the closed wrap ring support member 50 with the sheet S sliding by the outer periphery of the wrap ring support member 50, completing the cycle.

Preferably, after clamping the sheet S, the corners S1 and S2 are held in slight tension by right-hand cushion cylinder [s] 56 and cylinder 60 to approximately one half to one pound tension.

The wrap ring support member 50 is specifically designed to have a truncated conical shape and an average diameter of approximately 4", 5", 6", or 8". This allows wrapping the cone of the sheet S tightly without damaging or crushing the bouquet and automatically sets up the required path of the right-hand and left-hand wrap unit assemblies 1 and 2. That is, for a larger diameter bouquet to be wrapped, the extent of the movement of the racks which swing the right-hand and left-hand wrap unit assemblies 1 and 2 about the bouquet, is greater than it would be for a smaller diameter bouquet. These movement and timing functions, which result in corresponding mechanical movement functions, can be controlled by a central processor or any type of electromechanical timing element. Such electronic and electromechanical timing devices are well known in various arts, including washing machines, VCRs, and the like, and no discussion of the operation of such devices is deemed necessary or warranted in this description.

The specific arrangement described herein is merely one example of a preferred embodiment of the invention. It will be apparent to those skilled in the art that changes may be made in the construction and in the operation of the various components, elements and assemblies described herein, or in the steps or the sequence of steps of the methods described herein, without departing from the spirit and scope of the invention. For example, with a mathematical analysis of the desired path for a particular size bouquet, a cam or gear system could be designed to force the pinch clamp 11 and the vacuum cup 29 to follow a prescribed path without having to operate a series of actuators during movement of the right- and left-hand wrap unit assemblies 1 and 2. Further, an automatic bonding unit can be employed to bond the overlapped area of the sheet S. For example, conical roller 34 could be heated or vibrated to effect bonding between itself and the rigid wrap ring support member 50. Optionally, an automatic bonding unit could be employed to place an elastic or nonelastic band about the wrapped bouquet. Accordingly, the invention is to be interpreted only as to the scope of the appended claims.

What is claimed is:

1. A method for automatically wrapping a sheet of material about a floral grouping, the floral grouping having a bloom end with one or more blooms and a stem portion comprising one or more stems, said method comprising the steps of:

providing a sheet of material selected from the group of materials consisting of plastic or polymer films, fibers or fabric, metallic and non-metallic foils, paper, cellulose, leather, burlap, waxed sheet material, starched or sugared sheet material, and laminates, or combinations thereof;

placing the sheet of material on a support surface;

providing the floral grouping and positioning the floral grouping on the sheet of material;

automatically gripping a first portion of the sheet of material via a first gripping unit; and automatically gripping a second portion of the sheet of material opposite the first portion of the sheet of material via a second gripping unit;

automatically moving the gripped first portion of the sheet of material over the stem portion of the floral grouping via movement of the first gripping unit; and automatically moving the gripped second portion of the sheet of material over the stem portion of the floral grouping via movement of the second gripping unit.

2. The method of claim 1 comprising the additional step of automatically bonding a portion of the gripped second portion of the sheet of material to a portion of the gripped first portion of the sheet of material.

3. A method for automatically wrapping a sheet of material about a floral grouping having a bloom end comprising one or more blooms and a stem portion comprising one or more stems, the stem end distal to the bloom end, comprising:

providing a sheet of material selected from the group of materials consisting of plastic or polymer films, fibers or fabric, metallic and non-metallic foils, paper, cellulose, leather, burlap, waxed sheet material, starched or sugared sheet material, and laminates, or combinations thereof;

placing the sheet of material on a support surface;

providing the floral grouping and positioning the floral grouping on the sheet of material;

automatically gripping a first portion of the sheet of material via a first gripping unit;

automatically gripping a second portion of the sheet of material opposite the first portion of the sheet of material via a second gripping unit;

automatically moving the gripped first portion of the sheet of material over the one or more stems of the stem portion of the floral grouping via movement of the first gripping unit;

automatically moving the second gripped portion of the sheet of material over the one or more stems of the stem portion of the floral grouping via movement of the second gripping unit; and automatically causing the portions of the sheet of material which surround portions of the stem portion to be bound about the surrounded portions of the stem portion of the floral grouping.

4. The method of claim 3 comprising the additional step of automatically bonding a portion of the gripped second portion of the sheet of material to a portion of the gripped first portion of the sheet of material.

* * * * *